US006118884A

United States Patent [19]

Proni

[11] Patent Number: 6,118,884

[45] **Date of Patent: *Sep. 12, 2000**

[54] AUDIO VOICE COIL ADAPTOR RING

[76] Inventor: Lucio Proni, 2571 Mayfair La., Weston, Fla. 33327

[ * ] Notice: This patent is subject to a terminal disclaimer.

[21] Appl. No.: 08/964,095

[22] Filed: Nov. 4, 1997

Related U.S. Application Data

[63] Continuation of application No. 08/580,764, Dec. 29, 1995, Pat. No. 5,734,734.

[51] Int. Cl.[7] ..... H04R 25/00

[52] U.S. Cl. ..... 381/403; 381/400; 381/404; 381/407

[58] Field of Search ..... 381/407, 403, 381/409, 432, FOR 157, 400, 404, FOR 154, FOR 159, 420

[56] References Cited

U.S. PATENT DOCUMENTS 4,118,605 10/1978 Kobayashi ..... 381/407
5,734,734 3/1998 Proni ..... 381/400

*Primary Examiner*—Huyen Le
*Attorney, Agent, or Firm*—Holland & Knight LLP

[57] ABSTRACT

A voice coil adaptor ring and loudspeaker system of the moving coil type including a cone diaphragm supported by a frame, a voice coil former for supporting a voice coil, and a lower suspension for securing and centering the voice coil former in a magnetic gap while it is displaced by a magnetic circuit. The voice coil adaptor ring is mounted over the voice coil former and comprises a substantially cylindrical sleeve having at least one ledge extending outward from said sleeve for supporting the cone and lower suspension and a plurality of venting passages in fluid communication with a cone volume defined by the cone for venting hot air from the cone volume.

14 Claims, 5 Drawing Sheets

AUDIO VOICE COIL ADAPTOR RING

This application is a continuation of U.S. application Ser. No. 08/580,764, filed Dec. 29, 1995 now U.S. Pat. No. 5,734,734.

BACKGROUND OF THE INVENTION

1. Field of the Invention

The present invention relates generally to the field of loudspeakers, and in particular, to a voice coil adaptor ring for mating the cone and spider for increased strength and efficiency.

2. Description of the Prior Art

With reference to FIG. 1, a conventional loudspeaker 20 generally comprises a support frame 22, a cone 24, a dust cap 26 bridging across the cone, a suspension system, a voice coil 40, a voice coil bobbin/former 43, and a vented pole piece 41. The voice coil 40 is wound about the voice coil former 43 such that an annular magnetic gap is defined between a top plate 37 and the magnet and the voice coil 40. The magnetic circuit linearly cycles or displaces the voice coil former 43 in this gap. In the conventional speaker, the cone shaped diaphragm (cone 24) is attached to the voice coil former above the coil 40 at its lower end and to the frame at its upper end. A suspension system comprising two elements connects to the frame and upper end of the cone, and to the frame and voice coil former, respectively.

The suspension system of the loudspeaker normally comprises two elements, the surround 28 (upper or outer suspension) and the spider 38 (lower or inner suspension). The surround 28 is a mechanical device which holds the outer edge of the diaphragm/cone of the loudspeaker and is often referred to as a "roll." Typically, the surround comprises a single, large, semi-circular corrugation constructed from either rubber, compressed foam rubber, or some similarly treated fabric. Surrounds may also be constructed from several other materials including corrugated cloth, paper, plastic, etc. One purpose of the surround is to help keep the cone 24 centered and to provide a portion of the restoring force that keeps voice coil in the gap defined between the pole piece and the top plate of the loudspeaker. The surround also provides a damped termination for the edge of the cone. A choice of thickness and material type for surround construction can greatly alter the response of the loudspeaker.

A spider 38 is commonly constructed from treated corrugated fabric. The spider 38 comprises a lower/inner suspension member that helps to keep the voice coil concentric to the pole piece. A portion of the restoring force that maintains the voice coil within the gap is also provided by the spider. Thus, the stiffness of the spider can greatly affect the loudspeaker's resonance. The spider also provides a barrier for keeping foreign particles away from the gap area.

In addition to controlling the linear motion of the cone, the surround, like the spider, acts as a major centering force for the loudspeaker's voice coil. The voice coil generally comprises a winding concentrically supported by a cylindrical voice coil former. The centering force provided by the roll and spider prevents the voice coil and former from rocking and rubbing against the pole piece or top plate. Rocking is undesirable because it can cause audible noise and/or damage to the driver.

Often a loudspeaker design can be best optimized by utilizing a voice coil with a smaller diameter. However, the smaller voice coil setup creates certain problems, especially when designing loudspeakers for low frequency reproduction. Thus, for larger diameter loudspeakers (typically 10 inches and above), small voice coil systems are not common. Accordingly, there are few, if any, existing cones tooled for the smaller diameter coil former. To incorporate a small voice coil system, the cone must be customized, adapted or re-tooled.

One disadvantage of mating a cone directly to a smaller voice coil is that a relatively small adhesive joint is made. Since the voice coil's diameter is much smaller, the gluing circumference is drastically reduced. Therefore, the designer must be concerned with the possibility of mechanical failures since the stress distribution around the glue joint is high. Because the spider attaches at this critical junction as well, spider joint stress also increases, introducing yet another possible failure mode.

Another problem associated with smaller voice coils occurs in the use of pole vents. Pole vents comprise holes bored directly through the pole piece within the motor structure. These vents are used to relieve air pressure that builds up beneath the dust cap. Without a pole vent, audible noise can be introduced as the trapped air tries to escape during large cone excursions. However, when using a small diameter voice coil, the amount of metal in the pole piece is very limited. This amount of steel can only support limited amount of magnetic flux. Consequently, using a pole piece with large amounts of metal removed for pole vents can radically alter the performance of the magnetic circuit.

A vented pole piece further affects the thermal behavior of the speaker. The steel contained in the pole piece provides an effective thermal sink for the voice coil. Machining a pole vent in the pole piece increases thermal resistance of the sink, lowering the power handling capability of the loudspeaker.

The mechanical integrity of the spider is also compromised when using a small voice coil. Spiders are typically made from resin treated cloth materials. When the inner diameter of the spider gets smaller, fewer strands of material intersect the cutout. Since the glue joint lies on this small circumference, very little spider material is captured. This places the spider material under greater stress than normal. This high-stress condition could cause the spider itself to fatigue prematurely. Since the spider is typically called on to center the moving assembly and limit cone motion at the extremes of excursion, a compromised spider could cause a catastrophic failure.

Rocking resistance is also compromised when using a smaller inner diameter voice coil. Rocking in a loudspeaker describes the moving assembly rotating in the vertical plane about a point located along its axis of motion. As a spider's inner diameter gets larger, the material along the inner diameter is required to deflect more when the moving assembly rotates a given amount (as during rocking). Consequently, a spider with a larger inner diameter will be more resistant to rocking because more energy is required to invoke a given angular change. It follows that using a small voice coil, and hence a small inner diameter spider, makes a given loudspeaker more susceptible to rocking related problems.

The smaller voice coil system further affects the cone's structural integrity. As a voice coil gets smaller, the cone angle increases (using a vertical axis as a reference), causing the cone to become flatter. As the cone begins to flatten, its mechanical strength drops. Increasing the cone angle increases the likelihood of audible degradation due to cone flexure. Normally, the only option available for preventing cone flexure is to increase the cone thickness and/or increase the cone depth. This decreases the cone angle and makes the cone wall more vertical. These solutions, however, are not desirable since increasing the cone depth requires a larger frame depth and using a thicker cone adds weight to the moving structure. Moreover, thicker cones and deeper frames require special tooling and make the speaker's mounting depth unattractive for certain applications.

Several loudspeaker designs are contemplated in the background art for improving speaker performance, stabilizing the speaker cone/diaphragm, and/or simplifying the manufacturing process. However, none of these references solve the above-noted problems. For example, Mitobe (U.S. Pat. No. 5,111,510) discloses a speaker and manufacturing method therefor including a diaphragm integrally combined with a first frame piece and a driver unit integrally combined with a second frame piece. Saiki et al. (U.S. Pat. No. 5,371,805) discloses a speaker and speaker system employing the same, comprising a diaphragm secured to a first periphery of an edge member and a frame secured to a second periphery of the edge member. Scholz (U.S. Pat. No. 5,323,469) discloses a conical loudspeaker having a conical stabilizing element joined between an underside of a speaker membrane and an outside surface of a speaker moving coil carrier. Kreitmeier (U.S. Pat. No. 5,424,496) discloses an electromagnetic converter comprising an internal magnet system, a moving coil and tubular segment. Kreitmeier (U.S. Pat. No. 4,764,968) discloses a disk-like diaphragm made from a conical plastic film and provided with vacuum formed support members which extend up to the disk-like radiating layer. Finally, Kobayashi (U.S. Pat. No. 4,118,605) discloses a coil mount structure comprising a cylindrical member, around one end portion of which a diaphragm edge is fixed, an inner peripheral edge portion where a damper is removably fixed, and an opposite end portion around which a coil is provided. Kobayashi, however, does not provide any structure for ventilating air pressure from beneath the dust cap or a structure for creating a secure joint between the diaphragm/cone, spider, and/or voice coil. The present invention, by way of contrast, is directed to an adaptor ring, the structure of which facilitates a stronger adhesive joint between the cone, spider, and voice coil bobbin or former, and a means for venting air pressure buildup.

The above-noted background art neither solves or addresses the problems contemplated by the present invention. Accordingly, there remains a need for a loudspeaker capable of providing improved structural joints between the speaker cone, spider, and voice coil former, allowing the use of smaller voice coil systems and providing ventilation in the speaker without forfeiting performance. The instant invention addresses the needs in the art by providing a voice coil adaptor ring that provides increased stability to the speaker cone, spider, and voice coil former, and that facilitates the reliable use of smaller voice coils in loudspeaker designs, including low frequency speakers. The instant invention also addresses the need for improved ventilation.

SUMMARY OF THE INVENTION

An object of the present invention is to provide a structure that facilitates the secure attachment of a cone edge, spider, and voice coil for improved loud speaker performance.

Another object of the invention to provide a voice coil adaptor ring that allows for a stronger joint between the cone/diaphragm, spider/lower suspension and voice coil.

It is also an object of the invention to provide a voice coil adaptor ring that makes it possible to use relatively small voice coils in low frequency speakers.

It is a further object of the invention to provide a voice coil adaptor ring that eliminates the need for machining pole vents in the pole pieces of loud speakers.

It is an additional object of the invention to provide a voice coil adaptor ring that facilitates use of a larger inner diameter spider that is more resistant to rocking.

It is another object of the invention to provide a voice coil adaptor ring that makes it possible to reduce the cone angle for a given voice coil size to strengthen the cone.

It is still an additional object of the invention to provide a voice coil adaptor ring that provides a structure that eliminates the need for adhering the spider and cone to the voice coil former.

It is still a further object of the invention to provide a structure that allows the cone to mechanically lock and secure the spider suspension.

It is yet another object of the instant invention to reduce the number of failure points in a loudspeaker and the probability of loud speaker failure.

Another object of the instant invention is to reduce stress in the joints securing the spider and cone.

A further object of the instant invention is to provide a voice coil adaptor ring that allows the cone to be attached further out from the voice coil former to increase the vertical angle of the cone and hence the cone's strength.

According to these and other objects, the present invention comprises a voice coil adaptor ring and a loudspeaker with a moving coil that incorporates the adaptor ring. The loudspeaker comprises a cone, a dust cap, a frame supporting the cone's upper end, a voice coil former, a voice coil wound around the former, the adaptor ring mounted to the former, a lower suspension (spider) connected at one end to the frame and at the other end to the adaptor ring for centering the voice coil system, and a magnetic circuit including at least one magnet, front plate, a back plate and a pole piece. The adaptor ring comprises a substantially cylindrical sleeve adapted for mating over the voice coil former and for securing and attaching the speaker cone/diaphragm and spider suspension. The adaptor ring of the instant invention defines at least one ledge around its lower peripheral edge having sufficient surface area for receiving, supporting and adhering the speaker cone and spider. Accordingly, the ledge is also referenced as a spider plateau since it provides a horizontal platform for supporting the spider. The spider plateau stabilizes and increases the structural integrity of the cone for minimizing deflection and providing an overall improved performance and strength. This plateau/edge provides a larger surface area for adhering the spider which is superior to gluing it directly to the vertical wall of the voice coil former, as shown in U.S. Pat. No. 4,764,968. By providing a substantially horizontal plateau for securing the spider suspension, adhesives may be applied to both the upper and lower sides of the spider for increasing the adhesive contact area. The extra adhesive contact area defined by the plateau provide for a strengthened spider attachment so as to greatly reduce the possibility of failure.

The plateau also benefits the cone in that it provides a mechanical stop for receiving the cone's lower edge and adhering it to the adaptor. This enhances the joint between the cone and adaptor for increased reliability and reduced likelihood of failure. If the cone is attached to the top of the spider, the spider can be completely locked and secured in place so as to virtually eliminate this joint as a possible failure point in the loudspeaker. A substantial decrease in stress on the glue joints is realized by the structure and method of the instant invention. In short, there is better stress distribution across the joint and increased stability provided by the spider plateau.

The adaptor ring of the instant invention further comprises venting passages vertically bored through the wall of the adaptor ring from top to bottom for releasing air pressure build up in the volume defined by the cap and/or cone. These venting passages of the instant invention eliminate the need for providing a pole vent in the pole piece. Eliminating the pole vent reduces manufacturing time and costs. A solid pole piece also offers an increase in magnetic circuit efficiency as well as a less resistant thermal path for heat transfer from the voice coil. An improvement in the heat transfer from the voice coil increases the power rating of the driver making the speaker more reliable. It has been determined that when a fairly porous spider is paired with the venting passages, air may exit noiselessly from the cone volume.

The adaptor ring of the instant invention defines an inner diameter adapted to receive the voice coil former for mounting the adaptor ring on the speaker. Accordingly, the cylinder is dimensioned to correspond to the voice coil former. An inner glue flange may be defined along the inner wall and floor of the adaptor ring. When the adaptor ring is installed over the voice coil former an inherent gap remains between the interior wall of the ring and the voice coil former. This gap is filled with glue to adhere the adaptor ring to the voice coil former. In the alternative, the voice coil former may have a stop projecting from the former for locking the adaptor ring in place.

The spider plateau of the adaptor ring may also include at least one wire channel, or slots in the inner glue flange along its circumferential edge to form channels when the adaptor is mounted to the former, for running speaker wires, such as the lead out wire. In the alternative, the wire may be passed through one of the venting passages. The ring may also include a textured or ribbed surface for increased surface tension when applying adhesives.

While the instant invention is described with reference to loudspeakers having small voice coils, the voice coil adaptor ring may be incorporated with other loudspeakers for improved performance and strength.

The invention is described in detail below with reference to the accompanying drawings, in which:

DESCRIPTION OF THE PREFERRED EMBODIMENTS

With reference to the drawings, FIGS. 2–9, depict the preferred embodiment of the voice coil adaptor ring 51 and loudspeaker system 50 incorporating the adaptor ring 51 in accord with the preferred embodiment of the instant invention. The loudspeaker 50 of the instant invention incorporates the voice coil adaptor ring 51 and comprises a cone-shaped diaphragm 24' (cone), a frame 22' supporting the upper end of the cone 24', a voice coil 40' wound around a voice coil former 43', the voice coil adaptor ring 51 mounted over the former 43', an upper suspension 28', a spider 38' and a magnetic circuit. The spider 38' is attached and adhered to the adaptor ring 51 to provide a centering force for the former 43' and voice coil 40'. The magnetic circuit comprises at least one magnet 35', a pole piece 41', a front plate 37' and a back plate 33'. A magnetic gap exists between the top plate 37' and the pole piece 41. Together, the adaptor ring 51 and spider suspension center the voice coil system and former in this gap.

Figure 4:
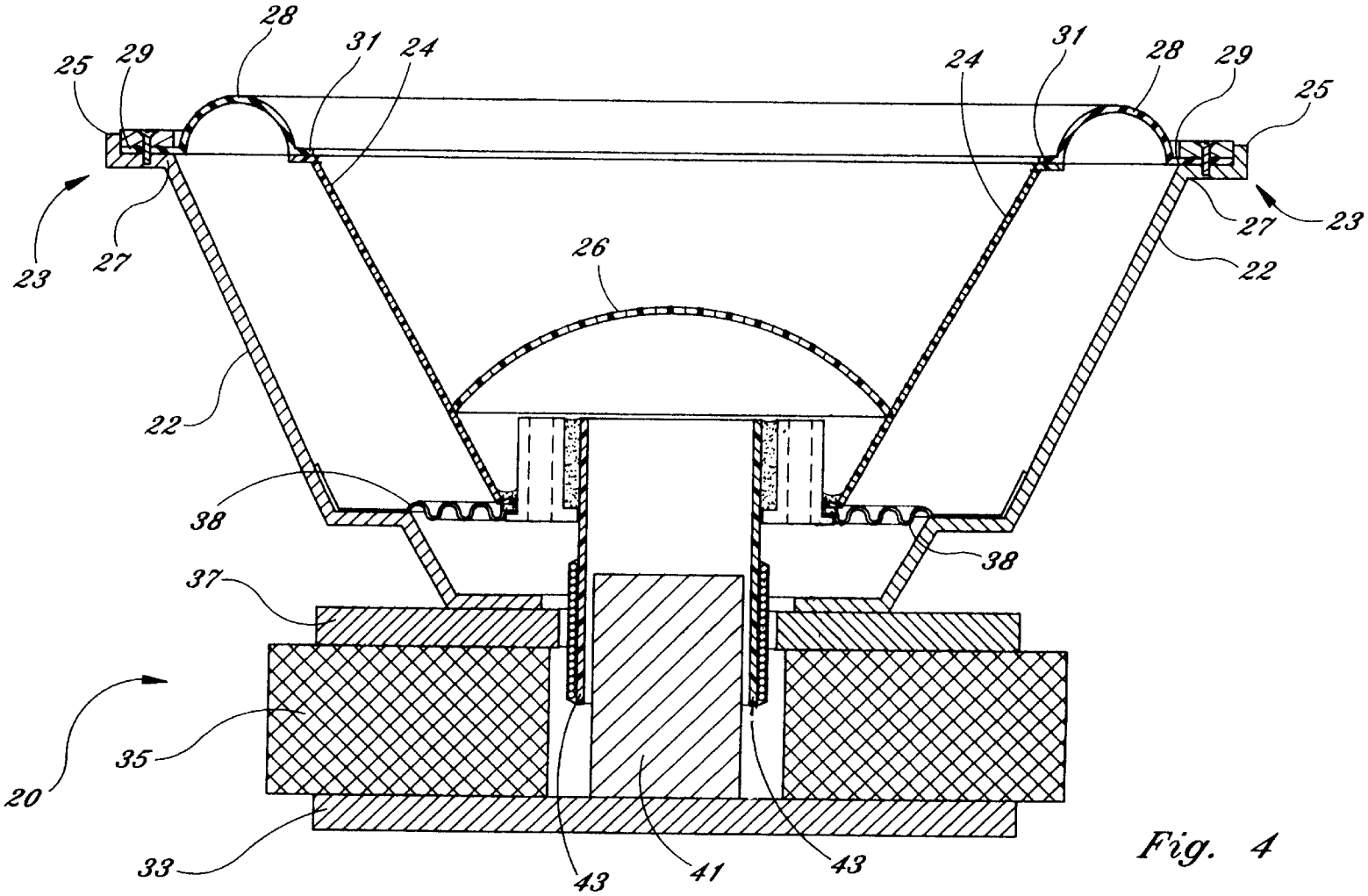
FIG. 4 is a cross-sectional view of the preferred embodiment of the loudspeaker and voice coil adaptor ring of the instant invention, as installed in the loudspeaker.
Figure 5:
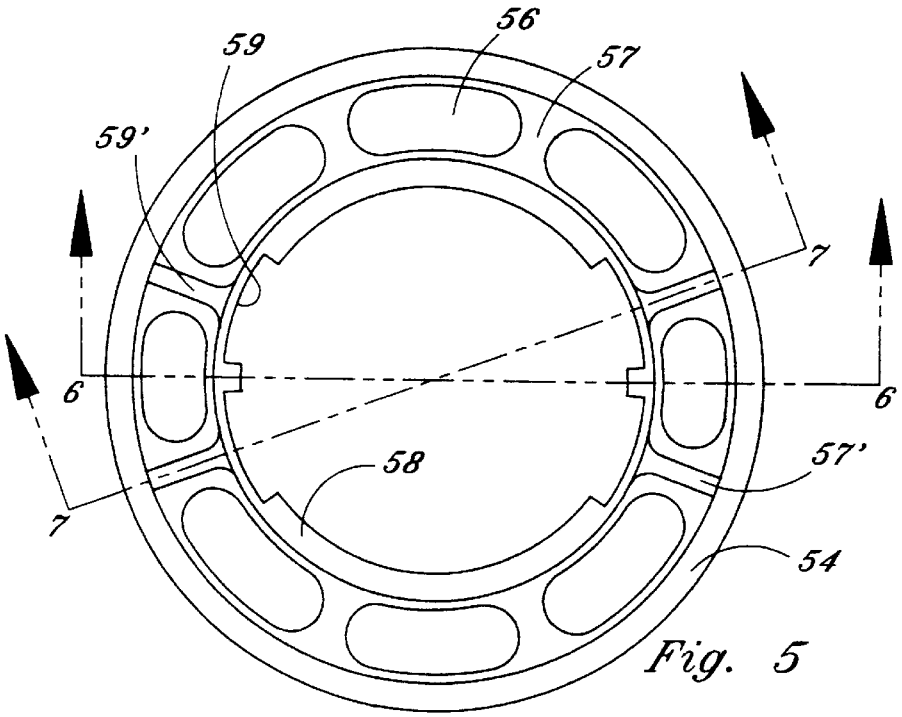
FIG. 5 is a top planar view of the voice coil adaptor ring of the instant invention.
Figure 9:
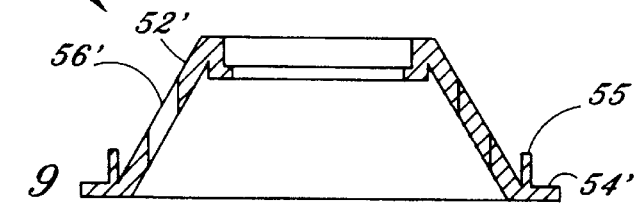
FIG. 9 is a cross-sectional view of another embodiment of the adaptor ring of the instant invention.

The voice coil adaptor ring 51 comprises a sleeve having substantially cylindrical walls 52 adapted for snugly mating and conforming to the outer peripheral edges of the voice coil former 43'. With reference to FIG. 9, the adapter ring in the alternative may comprise other shapes, such as conical, without departing from the scope and spirit of the instant invention. As seen in FIG. 4, the adaptor ring S defines a first inner diameter Dl which corresponds to the diameter/dimensions of the voice coil former 43'. The first inner diameter D1 of the adaptor ring 51 may be defined by an inner glue flange 58. A second inner diameter D2, larger than the first, is defined by the exterior of wall 52*a*. Thus, a gap exists between the interior wall 52*a* and the exterior wall of voice coil former 43' when the ring 51 is installed. This gap is filled with epoxy 60 to secure the adaptor ring 51 to the voice coil former 43,. Since the ring 51 inner diameter mounts over the voice coil former 43', an inherent gap is still present for adhesives without the inner flange 58. Adhesive adheres the ring 51 to the former 43'.

In the alternative, the former 43' may be manufactured with a projecting shelf on which the adaptor ring would sit and lock in place. In this alternative embodiment, the inner glue flange 58 would define grooves 59 which would interlock with the projecting shelf where the adaptor ring is rotated, locking it in place.

The adaptor ring 51 further comprises venting passages 56 which are bored vertically through the cylindrical walls 52 to provide a complete passageway for venting air from the cone volume of the speaker. The cone volume is defined by the cone walls 24' and dust cap 26'. In a speaker with just a cone 24, the cone volume is defined by the cone 24. The venting passages 56 prevent pressure build up in this volume for improved sound quality.

Figure 6:
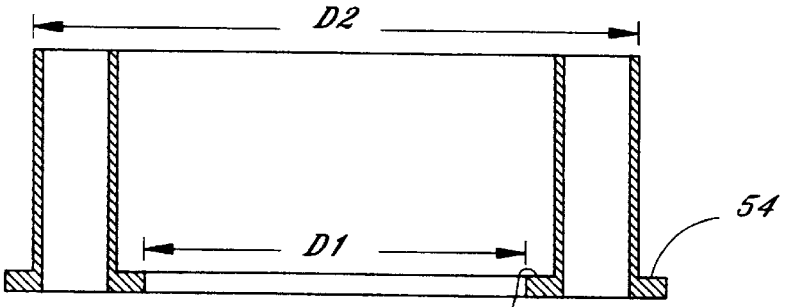
FIG. 6 is a cross-sectional view of the voice coil adaptor ring of the instant invention taken along line 6—6 of FIG. 5.
Figure 7:
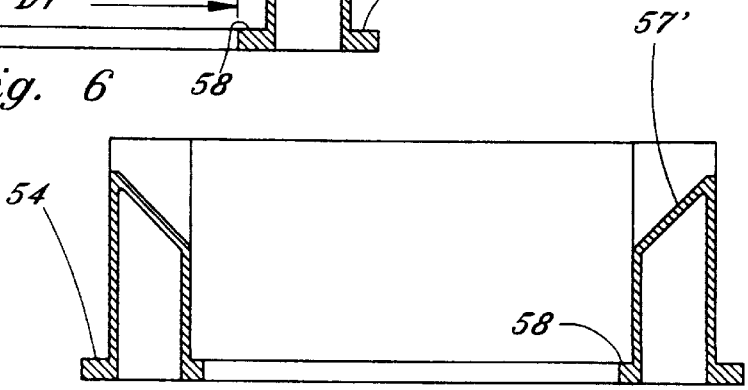
FIG. 7 is a cross-sectional view of an embodiment of the voice coil adaptor ring taken along line 7—7 of FIG. 5.

With reference to FIGS. 6–7, a cross-section of the adaptor ring is shown to illustrate the venting passages 56 and the inner glue flange 58. The passages 56 are divided by partitions 57. The partitions 57 may be sloped, tapered, planar or otherwise. Selected partitions 57' may be sloped, as shown in FIG. 7, to reduce stress on lead out wires when they are run through the adaptor 51. Lead out wires are typically fragile, so bending the wires at right angles would increase the risk of fractures. Referring to FIGS. 2–7, the adapter ring 51 includes a means for running lead out wires. This wire running means preferably comprises slots 59 defined at selected locations around the inner peripheral edge of the inner glue flange 58 so that wire running channels are formed when the adapter ring 51 is mounted to the voice coil former 43'. The slots 59 should be in alignment with the sloped partitions 57' so that lead out wires may be passed through the wire channels and over the sloped partitions. In the alternative, wire channels may be bored through the adapter ring walls 52, plateau 54 or inner glue flange 58. The adaptor ring 51 may be manufactured by any plastic, thermoplastic, polymer plastic, metal or other acceptable material. An injection molding process is preferred to make the ring 51. It should be noted, however, that any embodiment of the adapter ring may be manufactured integrally with the voice coil former 43', such that the adapter ring would be metallic. At least one wire channel 55 may also be provided by the ring 51 for running wires.

Figure 1:
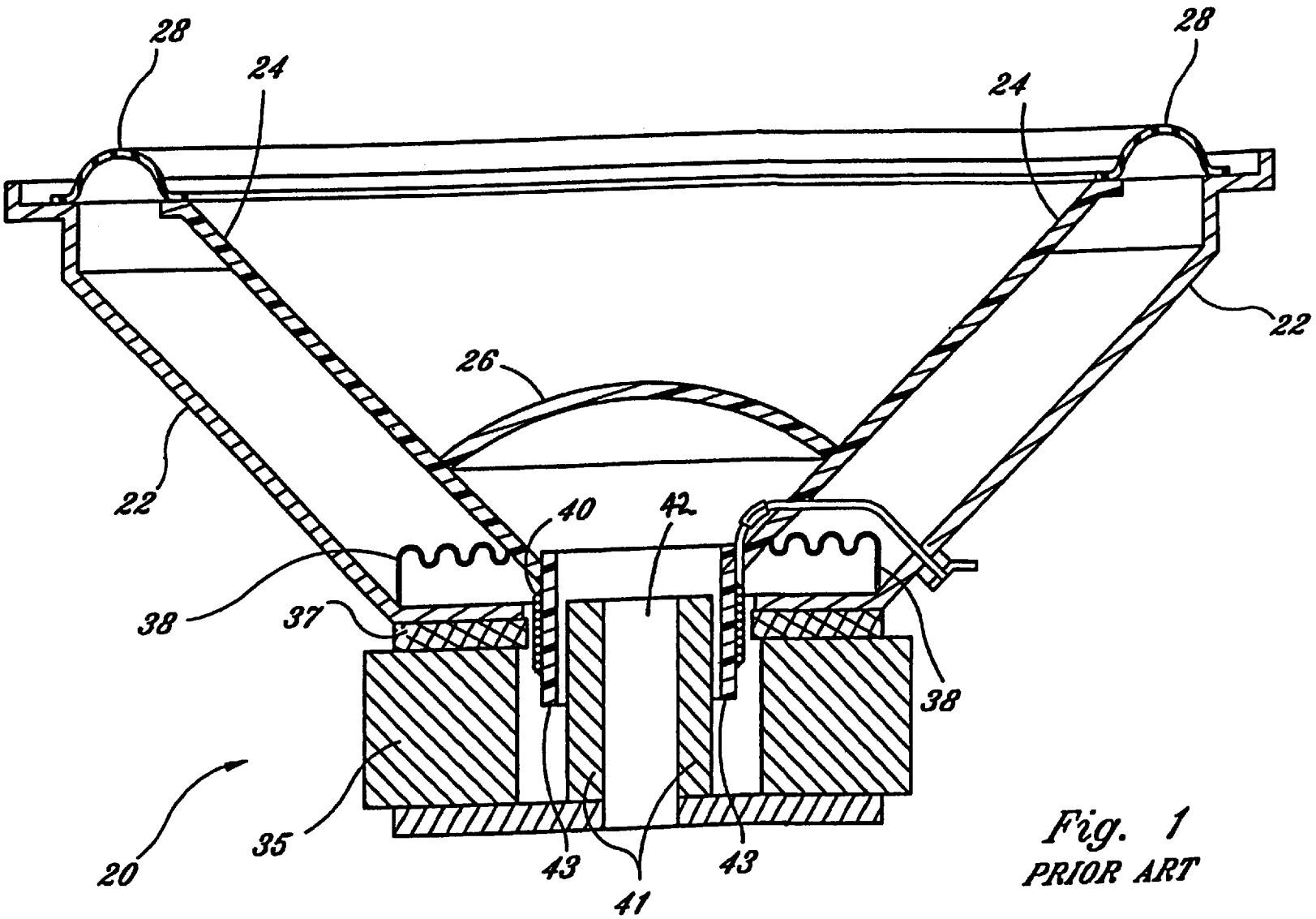
Fig. 1 PRIOR ART
FIG. 1 is a cross-sectional view of a prior art loudspeaker.
Figure 1A:
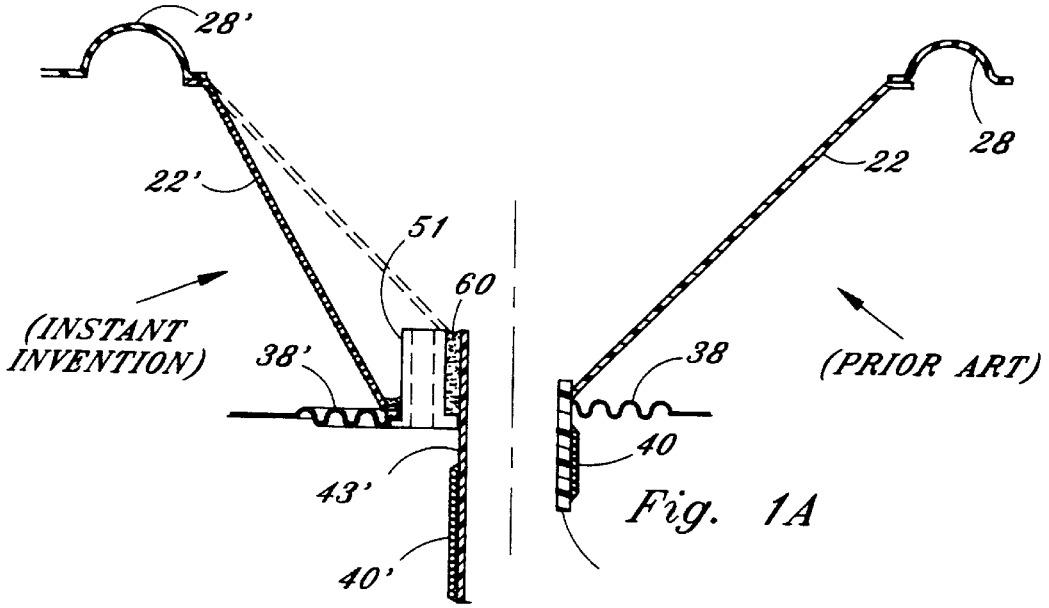
FIG. 1A is an illustration of the cone angle increase when incorporating the instant invention.
Figure 2:
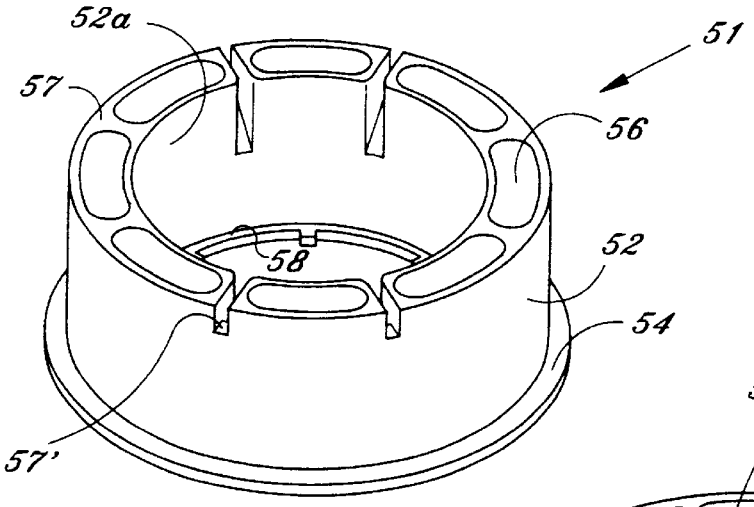
FIG. 2 is a top perspective view of the preferred embodiment of the voice coil adaptor of the instant invention.
Figure 3:
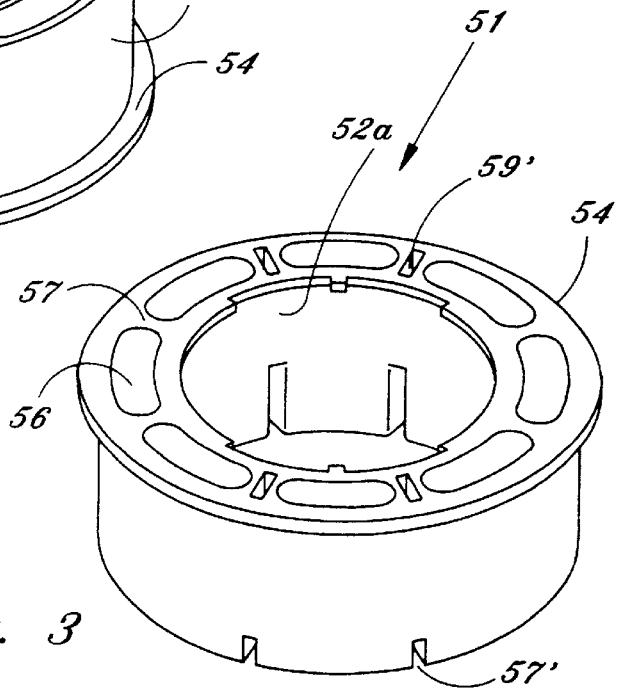
FIG. 3 is an bottom perspective view of the voice coil adaptor of the instant invention.

The venting passages 56 eliminate the need for a pole vent 42, as shown in FIG. 1. The conventional pole vent 42 is required in the background art to vent heat and air pressure build up in the cone volume, as defined by the dust cap 26 and the cone 24. The voice coil adaptor ring 51 of the instant invention eliminates the pole vent 42 by including venting passages 56 in the adaptor ring 51, as discussed above. The venting passages 56 comprise channels bored completely through the cylindrical wall 52 from the top end to the bottom end. Replacing the conventional pole vent 42 with the adaptor ring vent passages 56 saves machining in the pole piece structure 41 so as to reduce costs. A solid pole piece 41 also increases magnetic circuit efficiency and provides an improved thermal path for heat transfer from the voice coil. By allowing for improved heat transfer from the voice coil, the driver may be operated at a higher power rating.

With reference to FIGS. 2–8, the adaptor ring 51 of the instant invention preferably has cylindrical walls 52 that define at least one exterior spider plateau 54. The spider plateau 54 is preferably planar, or substantially horizontal, such that it provides a ledge for receiving and securing the spider/lower suspension 38' and the neck/lower edge of the speaker cone 24'. The spider plateau 54 preferably supports the inner edge of the spider 38' and provides enough surface area for applying adhesives between the spider 38' and the ledge 54 so as to firmly secure the spider in place. Adhesives may also be applied to the upper surface of the spider 38' for adhering the neck of the cone 24'. The instant invention is superior to the background art, whereby the ledge 54 of the adaptor ring 51 provides a more stable securing structure than the vertical surface of the voice coil former 43'. In addition, it provides a structure that enables the joining of the cone 22' and spider 38' for a stronger joint. Accordingly, attaching the spider 38' and cone 24' to the voice coil adaptor ring 51 along a larger circumferential planar surface provides more contact area for applying epoxy. This additional contact area alleviates stress on the glue joints via improved stress distribution for increased reliability. In the alternative, the surface of the spider plateau 54 and/or the entire adaptor ring 51, can be textured or ribbed to enhance adhesion. The adaptor ring 51 and spider plateau 54 also provide a mechanical stop for the cone's 24' lower edge providing a more reliable joint. Once the cone 24' is attached to the top of the spider 38', the spider 38' is completely locked in place. Consequently, the spider/cone/voice coil joint is virtually eliminated as a possible point of failure in the loudspeaker.

Referring to FIG. 4, the voice coil adaptor ring 51 provides extra coil attachment height allowing for a larger adhesive contact area, especially in small diameter voice coils. In addition, an inner glue flange 58 may aid in the gluing process by catching and holding the glue in contact with the coil former surface allowing a larger amount of adhesive to be used. This large joint provides a more favorable stress distribution around the coil former 43' making the attachment more reliable.

The voice coil adaptor 51 facilitates use of a corrugated spider 38' having a larger inner diameter in the area of its mid section. A spider with a large inner diameter is amenable with the instant invention because of the additional security provided by the voice coil adaptor ring 51 and spider plateau 54. That is, because more spider material is adjacent to the glue joint in a loudspeaker using the voice coil adaptor in 51, spider fatigue is less of a concern. As noted, a larger inner diameter spider 38' is more resistant to rocking that may incur in a loudspeaker. With the use of the adaptor ring 51, the acceptable spider material deflection is increased for a given degree of coil rotation making the spider more resistant to fatigue. The additional stability provided by the adaptor ring 51 and corrugated spider 38', make the speaker stronger and more reliable. The improved centering force allows for tightened tolerances in the magnetic gap as defined between the top plate 37, and pole piece for improved speaker performance. Maintaining a smaller magnetic gap increases the motor strength and enhances the thermal power handling of the loudspeaker.

The adaptor ring 51 moves the contact point of the lower cone edge outward. As a result, the cone angle is decreased, with reference to a vertical axis, for higher strength and rigidity. As a result, the cone 24' is not only more reliably stabilized, but may be manufactured from a thinner material reducing the cone's weight and audible coloration.

Figure 8:
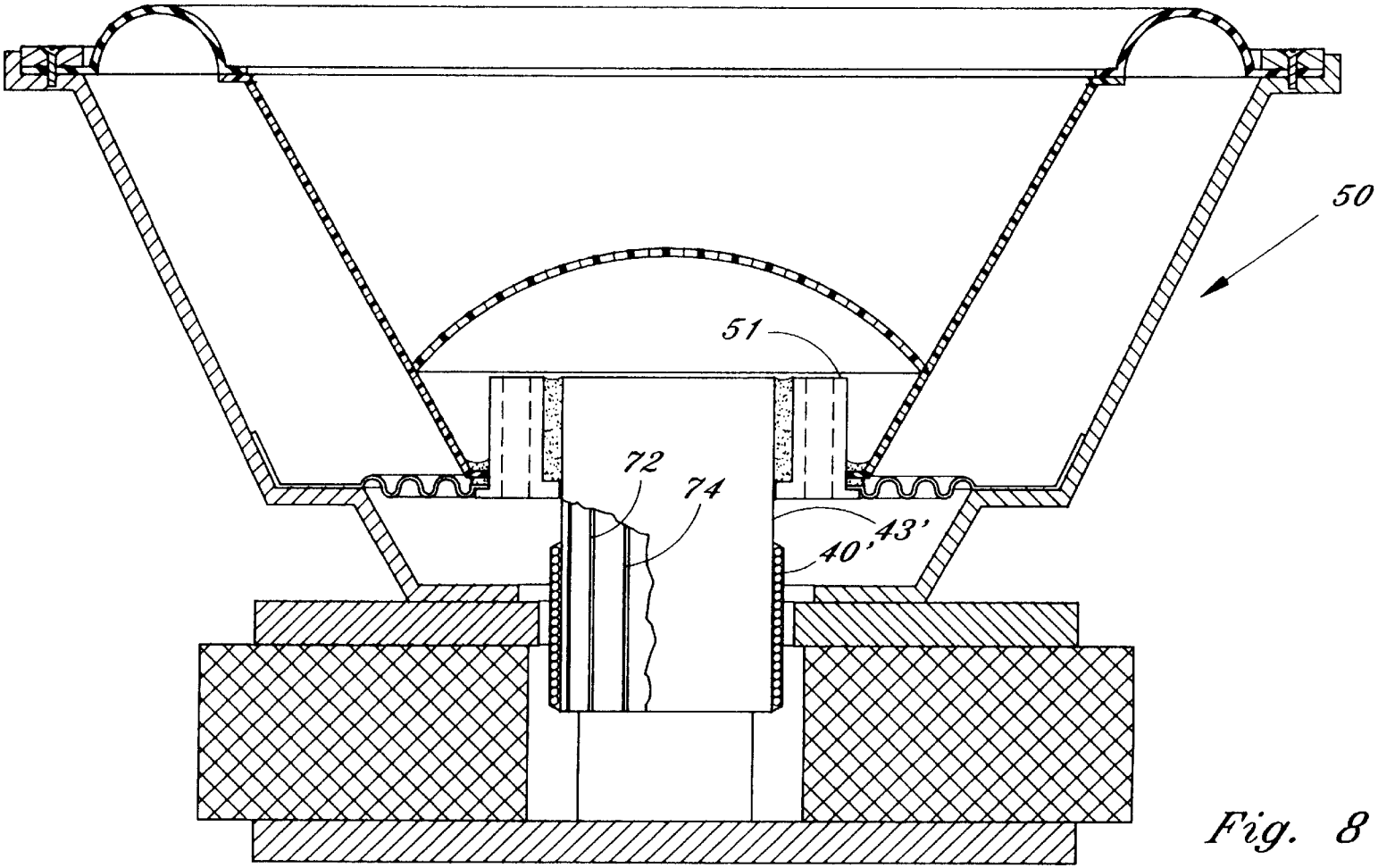
FIG. 8 is a cross-sectional view of another embodiment of the loudspeaker of the instant invention with a partial cutout in the voice coil former to illustrate grooves on the inner surface of the voice coil former when the former and adapter ring assembly are manufactured from a conductive material.

With reference to FIG. 8, the voice coil former 43' may have grooves 72 and 74 formed along the interior wall, preferably from top to bottom. The grooves 72 and 74 provide a means and structure for breaking any conductive loop in the former 43' that may result. These grooves 72, 73 may be especially necessary when the adaptor ring is formed integrally with the former 43' and the former-adaptor ring assembly is electrically conductive. An alternative embodiment of the adaptor ring is shown in FIG. 9, where the adaptor is conical in shape. The conical adapter 51' performs the same functions as the preferred adapter 51 and likewise comprises a spider plateau 54', a sloped wall 52', and vent passages 56'. A vertical stop 55 is also included in the alternative embodiment for receiving the cone and spider and facilitating an improved adhesion surface.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A loudspeaker adaptor ring for use with loudspeakers having a lower suspension a cone diaphragm, cone volume and voice coil former for supporting a voice coil, said adaptor ring comprising:

a sleeve formed with a wall having a first end, a second end, an inner surface defining a hollow interior and an outer surface spaced from said inner surface, said hollow interior being adapted to receive the voice coil former said wall of said sleeve being formed with at least one passage located in between said inner surface and said outer surface thereof for venting air:

a ledge extending outwardly from said outer surface of said sleeve, said ledge defining a planar surface adapted to support at least one of the lower suspension and cone; and means for securing said sleeve to the voice coil former, said securing means being partially defined by said sleeve.

2. The adaptor ring of claim 1 in which said passage extends between said first end and said second end of said wall.

3. The adaptor ring of claim 1 in which said passage comprises a number of passages spaced from one another along said wall.

4. The adaptor ring of claim 1 in which said wall is substantially cylindrical in shape, said passage comprising a number of circumferentially spaced passages formed in said wall.

5. An adaptor ring for use with loudspeakers having a lower suspension, a diaphragm and a voice coil former which mounts a voice coil winding, said adaptor ring comprising:

a sleeve formed with a wall having a first end, a second end, an inner surface defining a hollow interior and an outer surface spaced from said inner surface;

said sleeve being adapted to be positioned within the loudspeaker so that the voice coil former is received within said hollow interior of said sleeve and is connectable to said inner surface of said wall, and so that the lower suspension and the diaphragm are connectable to said sleeve;

said wall of said sleeve being formed with at least one passage located in between said inner surface and said outer surface thereof for venting air.

6. The adaptor ring of claim 5 in which said passage extends between said first end and said second end of said wall.

7. The adaptor ring of claim 5 in which said passage comprises a number of passages spaced from one another along said wall.

8. The adaptor ring of claim 5 in which said wall is substantially cylindrical in shape, said passage comprising a number ot circumferentially spaced passages formed in said wall.

9. The adaptor ring of claim 5 in which a ledge extends radially outwardly from said outer surface of said wall, said ledge being adapted to mount at least one of the diaphragm and the lower suspension.

10. A loudspeaker, comprising:

a frame, a magnetic circuit, a voice coil former carrying a voice coil, a diaphragm and a lower suspension;

an adaptor ring including a sleeve formed with a wall having a first end, a second end, an inner surface defining a hollow interior and an outer surface spaced from said inner surface;

said voice coil former being received within said hollow interior of said sleeve and being connected to said inner surface of said wall, said diaphragm and said lower suspension being connected between said frame and said sleeve;

said wall of said sleeve of said adaptor ring being formed with at least one passage located in between said inner surface and said outer surface thereof for venting air.

11. The loudspeaker of claim 10 in which said passage in said sleeve of said adaptor ring extends between said first end and said second end of said wall.

12. The loudspeaker of claim 10 in which said passage in said sleeve of said adaptor ring comprises a number of passages spaced from one another along said wall.

13. The loudspeaker of claim 10 in which said wall of said sleeve of said adaptor ring is substantially cylindrical in shape, said passage comprising a number of circumferentially spaced passages formed in said wall.

14. The loudspeaker of claim 10 in which said sleeve of said adaptor ring is formed with a ledge extending radially outwardly from said outer surface of said wall, said ledge mounting at least one of said diaphragm and said lower suspension.

* * * * *